US005758980A

United States Patent [19]

Takenaka

[11] Patent Number: 5,758,980

[45] Date of Patent: Jun. 2, 1998

[54] TAPE PRINTER PROVIDING IMPROVED LAYOUT OF DRIVE MOTOR AND BATTERY PORTION

[75] Inventor: Yuichi Takenaka, Nagoya, Japan

[73] Assignee: Brother Kogyo Kabushiki Kaisha

[21] Appl. No.: 818,453

[22] Filed: Mar. 17, 1997

[30] Foreign Application Priority Data

Mar. 26, 1996 [JP] Japan ..... 8-069811

[51] Int. Cl.[6] ..... B41J 11/26

[52] U.S. Cl. ..... 400/611; 400/613

[58] Field of Search ..... 400/621, 613, 400/611, 615.2; 235/58 CF, 58 R, 58 P, 61 R

[56] References Cited

U.S. PATENT DOCUMENTS

| | | | |
|---|---|---|---|
| 4,264,396 | 4/1981 | Stewart | 400/611 |
| 4,409,467 | 10/1983 | Honjo | 235/58 |
| 4,524,242 | 6/1985 | Fish, III et al. | 178/4 |
| 5,536,092 | 7/1996 | Yamaguchi | 400/231 |

FOREIGN PATENT DOCUMENTS

| | | | |
|---|---|---|---|
| 0 327 075 A2 | 8/1989 | European Pat. Off. . | |
| 0 592 198 A2 | 4/1994 | European Pat. Off. . | |
| 0045083 | 3/1982 | Japan | 400/613 |
| 0140179 | 8/1982 | Japan | 400/613 |
| 6-297774 | 10/1994 | Japan . | |
| A-7-68814 | 3/1995 | Japan . | |
| 1435950 | 5/1976 | United Kingdom | 400/611 |
| WO 93/14934 | 8/1993 | WIPO . | |

*Primary Examiner*—Edgar S. Burr
*Assistant Examiner*—Anthony H. Nguyen
*Attorney, Agent, or Firm*—Oliff & Berridge, PLC

[57] ABSTRACT

A portable tape printer having a reduced size. A control board and a cassette are positioned in vertically superposed relation within a case. A cut-away portion is formed at a broad surface of the control board and at one longitudinal end portion of the control board. A drive motor is disposed in a cut-away space. Thus, the drive motor is positioned at one longitudinal end portion of the control board. Further, a battery portion installing therein dry batteries is positioned at another longitudinal end portion of the control board. Reduction in size and weight balance result.

14 Claims, 3 Drawing Sheets

TAPE PRINTER PROVIDING IMPROVED LAYOUT OF DRIVE MOTOR AND BATTERY PORTION

BACKGROUND OF THE INVENTION

The present invention relates to a tape printer, and more particularly to a layout of various components used in the tape printer.

Japanese Patent Application Kokai (OPI) No. Hei 6-297774 and U.S. Pat. No. 5,536,092 disclose a portable and compact tape printer. The disclosed tape printer provides a case for installing therein a cassette, and a data input portion provided at a surface of a broad area portion of the case. The cassette accommodates therein at least a printing tape, and printing is formed on the printing tape based on image data such as character data inputted by the data input portion. The printed tape is discharged outside of the case.

FIGS. 5(*a*) and 5(*b*) also show another conventional tape printer. The tape printing device shown in FIGS. 5(*a*) and 5(*b*) includes a case 100 having an upper cover 100*a* and a lower cover 100*b* detachably connected to the upper cover 100*a*. Further, a control board 101 is provided along an inner surface of a broad area of the upper cover 100*a*. The control board 101 has a print data input portion 102 such as a keyboard and a liquid crystal display device 103 those being provided at an outer surface side or visible side of the broad area. The liquid crystal display device 103 has a display portion 103*a*. At a position below the control board 101, there are provided a cassette 105 accommodating therein a printing tape (not shown), a printing portion, a power transmission gear train 106 for feeding the printing tape, a drive motor 107 for driving the gear train, a battery portion 108 installing a plurality of dry batteries 108*a*, and a power source circuit 109. At least the print data input portion 102 and the display portion 103*a* are exposed at the surface of the broad area portion of the upper cover 100*a*. A tape cutting device 110 is provided adjacent a mating portion between the upper and lower covers 100*a* and 100*b*.

The printing tape in the cassette 105 is fed by the drive motor 107 and passes through the printing portion where image is formed on the printing tape. The printed tape is subjected to cutting by a predetermined length by the tape cutting device 110, and is discharged out of the case through a discharge port (not shown).

In the above described conventional arrangement shown in FIGS. 5(*a*) and 5(*b*), the drive motor 107 is positioned below the control board 101 and at a space defined between the cassette 105 and the battery portion 108. With this arrangement, heavy components such as the drive motor 107 and the battery portion 108 are disposed at a deviated portion in the case 100. That is, as shown in FIG. 5(*b*), the battery portion 108 and the drive motor 107 are positioned right half portion of the case 100. Therefore, weight imbalance may occur if the transportable type tape printer is held on a hand. Further, only the drive motor 107 is positioned in the space defined by the cassette 105 and the battery portion 108. Therefore, surplus space results in the case 100. Moreover, since the liquid crystal display device 103 is positioned opposite the drive motor 107 with respect to the cassette 105, a surplus area results at a side of the liquid crystal display device 103 even at the outer surface of the upper cover 100*a*.

SUMMARY OF THE INVENTION

It is therefore, an object of the present invention to overcome the above described conventional drawback, and to provide an improved compact and portable tape printer capable of reducing a dead space in a case and providing a proper weight balance when holding the printer on an operator's hand.

These and other objects of the present invention will be attained by providing a tape printer for printing an image on a tape wound in a tape cassette, the tape printer including a case, a printing portion, a power transmitting portion, and a drive motor. The case has an upper surface provided with a print data input portion and a display portion for displaying input print data. The case also has a cassette receiving portion disposed below the upper surface for receiving the tape cassette. The printing portion is adapted for forming the image on the printing tape based on the input print data. The power transmitting portion is adapted for feeding the tape relative to the printing portion. The drive motor is connected to the power transmitting portion and is positioned below the upper surface and above the tape cassette received in the cassette receiving portion.

In another aspect of the invention, there is provided a tape printer for printing an image on a tape wound in a tape cassette, the tape printer including a case, the display portion, the printing portion, the power transmitting portion, a drive motor, and a battery portion. The case has an upper surface and a cassette receiving portion disposed below the upper surface for receiving the tape cassette. The case has one longitudinal side and another longitudinal side which is opposite to the one longitudinal side. The drive motor is connected to the power transmitting portion and is disposed within the case and adjacent to the one longitudinal side. The battery portion is adapted for supplying an electrical power to the drive motor and is disposed within the case and adjacent to the other longitudinal side.

BRIEF DESCRIPTION OF THE DRAWINGS

In the drawings;

FIG. 5(*b*) is a cross-sectional view taken along a line V—V of FIG. 5(*a*).

DETAILED DESCRIPTION OF THE PREFERRED EMBODIMENTS

Figure 1:
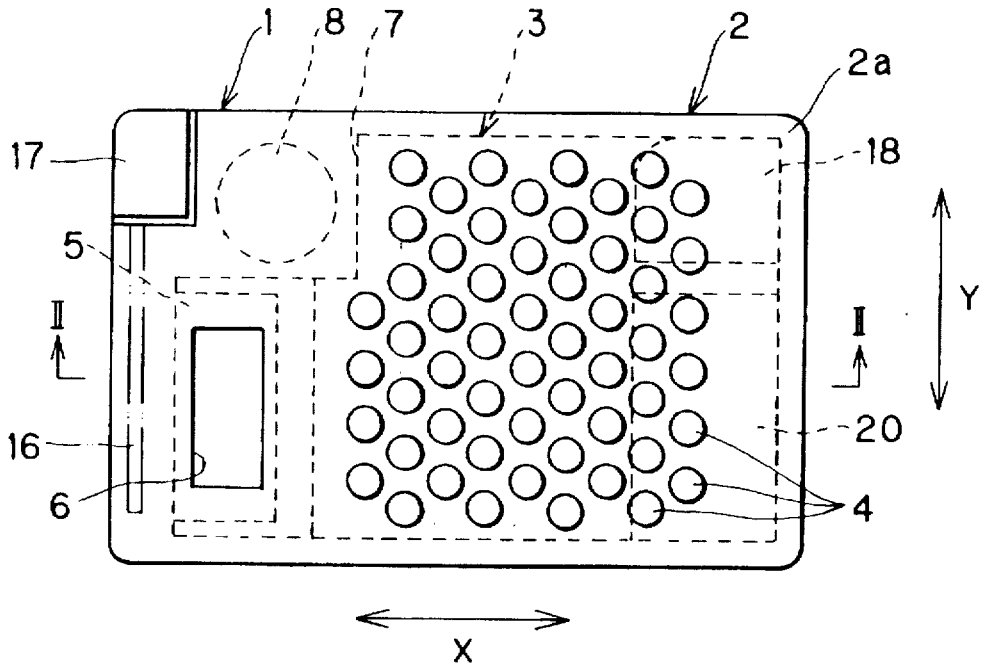
FIG. 1 is a plan view showing a tape printer according to one embodiment of the present invention.
Figure 2:
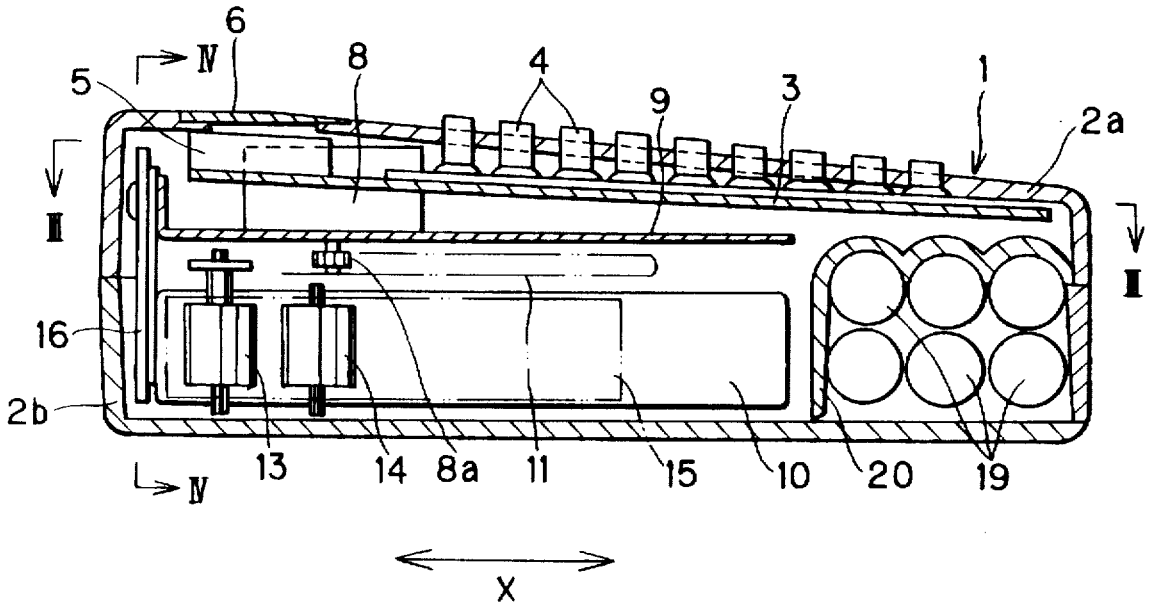
FIG. 2 is cross-sectional view taken along a line II—II of FIG. 1.

A tape printer according to one embodiment of the present invention will be described with reference to FIGS. 1 through 4.

The tape printer 1 includes a case 2 having an upper cover 2*a* and a lower cover 2*b*, these being made from synthetic resin by injection molding. The upper cover 2*a* is formed with a plurality of attachment holes and a rectangular window 6. A control board 3 is positioned in the vicinity of a back surface of the upper cover 2*a*. The control board 3 has an upper surface provided with a data input portion such as a keyboard switches 4 including alphabetic keys, numeric keys, function keys, etc. The keyboard switches are formed of a soft rubber. At a back surface of the control board 3, a print circuit and various electronic components (not shown)

are provided. At least each top surface of the keyboard switches 4 projects upwardly and exposed to outside through the attachment holes in the upper cover 2*a*.

Figure 3:
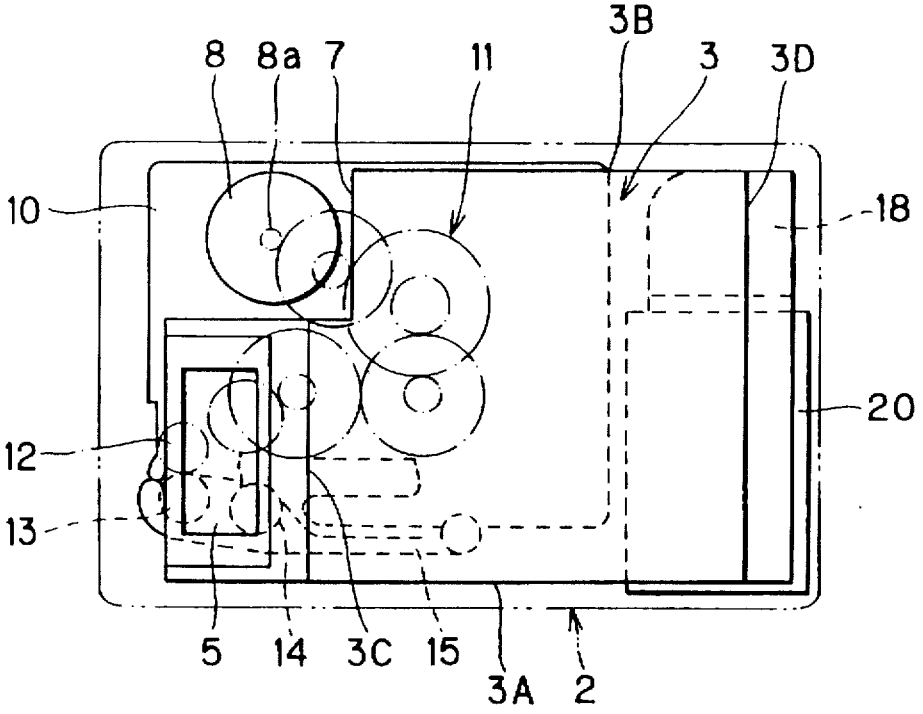
FIG. 3 is a cross-sectional view taken along a line III—III of FIG. 2.
Figure 4:
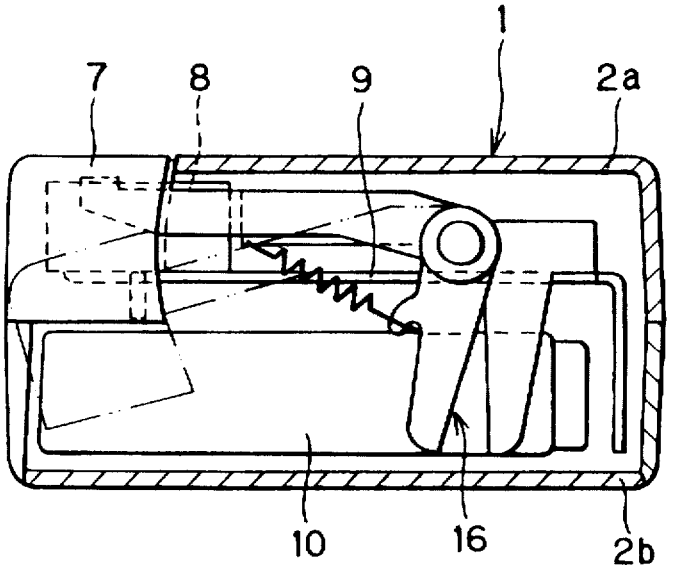
FIG. 4 is a cross-sectional view taken along a line IV—IV of FIG. 2.
Figure 5A:
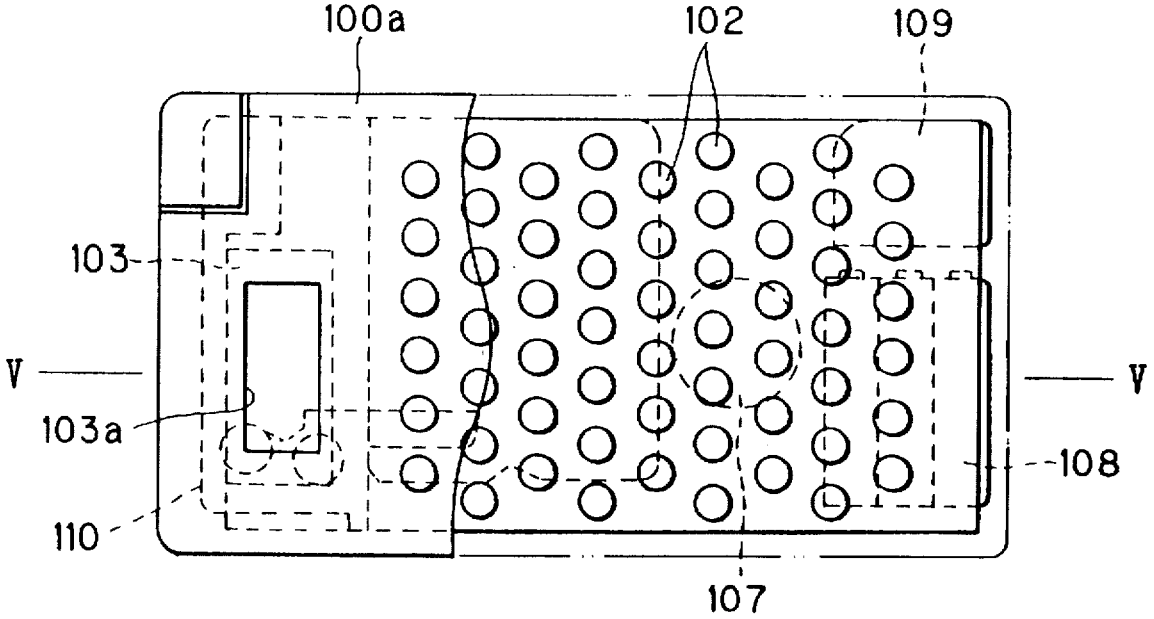
FIG. 5(a) PRIOR ART
FIG. 5(*a*) is a plan view showing a conventional tape printer.
Figure 5B:
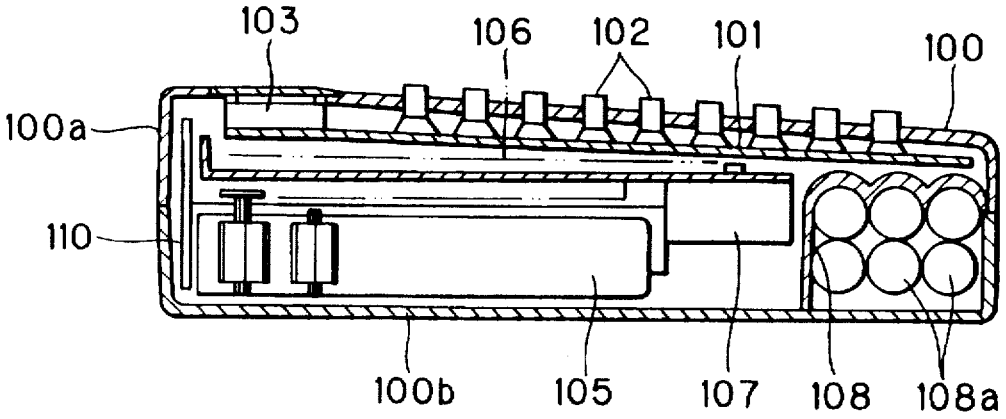
FIG. 5(b) PRIOR ART

As shown in FIGS. 1 and 3, the control board 3 has a generally rectangular shape having first and second sides 3A, 3B, and third and fourth sides 3C and 3D. The first and second sides 3A, 3B extend in parallel with each other in a direction X, and the third and fourth sides 3C and 3D extends in parallel with each other in a direction Y orthogonal to the direction X. A cut away portion 7 is formed at the third side 3C at a position adjacent to the intersection with the second side 3B.

A liquid crystal display device 5 serving as a print data display portion is fixed to the upper surface of the control board 3 at a position along the third side 3C. The display device 5 has a display surface which is visible through the window 6 formed in the upper cover 2*a*. The cutaway portion 7 is at a position beside the liquid crystal display device 5.

A frame 9 made of a metal plate is disposed below the control board 3 in parallel therewith. A drive motor 8 is fixedly mounted on the frame 9 and is disposed within the cut-away portion 7. That is, the drive motor 8 is disposed beside the liquid crystal display device 5 in the Y direction. The upper surface of the drive motor 8 provided on the frame 9 is positioned in the vicinity of the back surface of the upper cover 2*a*. A cassette 10 having a rectangular shape in plan view is detachably installed into the frame 9 at a position in confrontation with an inner surface of the lower cover 2*b*. Accordingly, a major plane of the control board 3, a major plane of the frame 9 and major plane of the cassette are positioned in superposed relation with one another in 10 a vertical direction.

In the tape cassette 10, a printing tape (not shown) is provisionally wound over a reel within the cassette 10. If a printing portion (not shown) is constituted by heat generating elements such as a thermal head, a heat sensitive sheet is available as the printing tape. Alternatively, a rolled heat sensitive ink ribbon is provided in the cassette 10 in such a manner that the heat sensitive ink ribbon extends along the surface of the tape when the thermal head presses against the ink ribbon for printing an image on the printing tape. Further alternatively, an adhesive agent can be coated on a back surface of the printing tape and a separable tape is adhered to the adhesive layer. Further, a tape feed roller 12 is rotatably provided in the cassette 10.

The drive motor 8 has an output shaft to which a pinion gear 8*a* is coupled. Further, a power transmitting portion 11 constituted by a power transmission gear train is rotatably supported to the frame 9. A driving power of the drive motor 8 is transmitted to the tape feed roller 12 through the pinion gear 8*a* and the power transmitting portion 11.

A holder 15 is pivotally movably supported to the case 2, and a pressure roller 13 and a platen roller 14 are attached to the holder 15. The pressure roller 13 is adapted for nipping the printing tape in cooperation with the tape feed roller 12, and the platen roller 14 is positioned in confrontation with the printing portion. An operation lever (not shown) is provided for pivotally moving the holder 15 toward and away from the tape feed roller 12 and the printing portion.

A press button 17 is disposed at a corner of the case 2 for actuating a tape cutter 16, and a tape cutter 16 is connected to the press button 17. If the press button 17 is depressed, the tape cutter 16 cuts the printed tape to a predetermined length at the printing portion, and the cut tape is discharged out of the case 2.

Further, within the case 2, a power source circuit portion 18 and a battery portion 20 containing a parallelly arrayed dry batteries 19 are provided along the fourth side 3D, i.e., at a position opposite the side of the drive motor 8 and the liquid crystal display device 5.

With this arrangement, because the drive motor 8 is disposed within the space of the cut-away portion 7 of the control board 3, and the base of the drive motor 8 is positioned at a space between the control board 3 and the cassette 10, it becomes unnecessary to form a space between the cassette 10 and the battery portion 19 at back side of the control board 3 for disposing the drive motor as in the conventional manner. Therefore, a length of the control board 3 in the X-direction can be reduced, and bulky case are not required to render the tape printer 1 short and compact.

Further, by disposing the drive motor 8 at one longitudinal side of the case 2, i.e., at a position adjacent the third side 3C, and by disposing the battery portion 20 at the other longitudinal end thereof, i.e., at a position adjacent the fourth side 3D, the drive motor 8 and the dry batteries 19 those being heavy components are distributed to opposite ends of the case 2, so that weight imbalance can be eliminated when the case 2 is held by a hand during data inputting operation. Accordingly operability of the tape printer can be improved.

Furthermore, by disposing the liquid crystal display device 5 along the minor side (third side 3C) of the broad surface of the control board 3, and by making the cut-away portion 7 for disposing therein the drive motor 8 at the position beside the liquid crystal display device 5 and along the minor side, the above described surplus space is not generated at the major side of the control board, thereby providing a compact tape printing device. That is, the longitudinal length (X-direction) of the control board 3 can be reduced, thereby reducing the longitudinal length of the case 2, to thus provide a compact tape printer.

What is claimed is:

1. A tape printer for printing an image on a tape wound in a tape cassette, the tape printer comprising:

a case having an upper surface provided with a print data input portion and a display portion for displaying input print data, the case also having a cassette receiving portion disposed below the upper surface for receiving a tape cassette;

a printing portion for forming the image on the printing tape based on the input print data;

a power transmitting portion for feeding the tape relative to the printing portion;

a drive motor connected to the power transmitting portion and positioned below the upper surface and above the cassette receiving portion; and a control board connected to the print data input portion and the display portion, the control board and the cassette receiving portion being superposed with each other and extending substantially parallel to the upper surface, the control board being formed with a cut away portion in which the drive motor is disposed.

2. The tape printer as claimed in claim 1, wherein the print data input portion is positioned in the case and to a side of the upper surface;

and wherein the case is formed with holes through which said print data input portion is exposed at the upper surface.

3. The tape printer as claimed in claim 1, wherein the control board has a first side at a first longitudinal end and a second side at a second longitudinal end, the cut away portion being positioned at the first side.

4. The tape printer as claimed in claim 3, wherein the drive motor is disposed adjacent the first side.

5. The tape printer as claimed in claim 4, further comprising a battery portion disposed within the case for supplying an electrical power to the drive motor.

6. The tape printer as claimed in claim 5, wherein the battery portion is disposed adjacent the second side.

7. The tape printer as claimed in claim 6, wherein the control board has a rectangular shape having said first side, said second side in parallel with said first side, a third side, and a fourth side, the third and fourth sides extending perpendicular to the first and second sides, the display portion being fixed to the control board at a deviated position on the first side, and the cut away portion being positioned on the first side and beside the display portion.

8. The tape printer as claimed in claim 7, wherein the battery portion is positioned immediately beside the cassette receiving portion in a direction of the third and fourth sides.

9. The tape printer as claimed in claim 8, further comprising a power source circuit portion, the battery portion and the power source circuit portion being provided along the second side.

10. A tape printer for printing an image on a tape wound in a tape cassette, the tape printer comprising:

a case having an upper surface provided with a print data input portion and a display portion for displaying input print data, the case also having a cassette receiving portion disposed below the upper surface for receiving a tape cassette;

a printing portion for forming the image on the printing tape based on the input print data;

a power transmitting portion for feeding the tape relative to the printing portion; and a drive motor connected to the power transmitting portion and positioned below the upper surface and above the cassette receiving portion, wherein the drive motor has a top end and a base end, said drive motor being positioned in said case so that the top end is in facing relationship with the upper surface of said case and the base end is in facing relationship with the cassette receiving portion.

11. The tape printer as claimed in claim 10, further comprising a battery portion disposed within the case for supplying an electrical power to the drive motor;

and wherein the case has a first side at a first longitudinal end and a second side at a second longitudinal end with said first side being opposite to said second side, the drive motor being disposed adjacent said first side and the battery portion being disposed adjacent said second side.

12. The tape printer as claimed in claim 11, wherein the display portion is disposed adjacent the first side.

13. A tape printer for printing an image on a tape wound in a tape cassette, the tape printer comprising:

a case having an upper surface provided with a print data input portion, and a cassette receiving portion disposed below the upper surface for receiving a tape cassette, the case having a first side at a first longitudinal end and a second side at a second longitudinal end with said first side being opposite to said second side;

a display portion for displaying print data;

a printing portion for forming the image on the tape based on the print data;

a power transmitting portion for feeding the tape;

a drive motor connected to the power transmitting portion and disposed within the case and adjacent to the first side;

a battery portion for supplying an electrical power to the drive motor and disposed within the case and adjacent to the second side; and a control board connected to the print data input portion and the display portion, the control board and the cassette receiving portion being superposed with each other and extending substantially parallel to the upper surface, the control board being formed with a cut away portion in which the drive motor is disposed.

14. The tape printer as claimed in claim 13, wherein the display portion is disposed adjacent the first side.

* * * * *